US008708107B2

(12) United States Patent
Finkbeiner

(10) Patent No.: US 8,708,107 B2
(45) Date of Patent: Apr. 29, 2014

(54) METHOD FOR MONITORING A LIFTING SYSTEM

(75) Inventor: Gerhard Finkbeiner, Freudenstadt (DE)

(73) Assignee: Walter Finkbeiner GmbH, Freudenstadt (DE)

( * ) Notice: Subject to any disclaimer, the term of this patent is extended or adjusted under 35 U.S.C. 154(b) by 847 days.

(21) Appl. No.: 12/083,616

(22) PCT Filed: Oct. 11, 2006

(86) PCT No.: PCT/EP2006/009835
§ 371 (c)(1),
(2), (4) Date: May 28, 2009

(87) PCT Pub. No.: WO2007/042284
PCT Pub. Date: Apr. 19, 2007

(65) Prior Publication Data

US 2009/0242333 A1 Oct. 1, 2009

(30) Foreign Application Priority Data

Oct. 11, 2005 (DE) ..... 10 2005 049 003

(51) Int. Cl.

| | |
|---|---|
| ***B66B 1/34*** | (2006.01) |
| ***B66B 3/00*** | (2006.01) |
| ***B66F 3/46*** | (2006.01) |
| *B66B 9/16* | (2006.01) |
| *B66F 7/20* | (2006.01) |

(52) U.S. Cl.
USPC ..... 187/393; 187/213; 187/240; 187/247; 187/391; 254/2 B; 254/89 R

(58) Field of Classification Search
USPC ..... 187/244, 274–276, 247, 390, 393, 213, 187/215, 240, 277, 391; 254/2 B, 7 B, 45, 254/89 R, 93 L; 60/428
IPC ..... B66F 3/02,3/46, 7/26, 7/20, 7/28
See application file for complete search history.

(56) References Cited

U.S. PATENT DOCUMENTS

| | | | | |
|---|---|---|---|---|
| 3,327,997 | A * | 6/1967 | Zenke | 254/89 R |
| 4,638,886 | A * | 1/1987 | Marietta | 187/215 |
| 4,777,798 | A * | 10/1988 | Jacobson et al. | 60/428 |

(Continued)

FOREIGN PATENT DOCUMENTS

| | | |
|---|---|---|
| DE | 103 49 424 A1 | 5/2005 |
| EP | 1 285 878 A1 | 2/2003 |

(Continued)

*Primary Examiner* — William A Rivera
*Assistant Examiner* — Stefan Kruer
(74) *Attorney, Agent, or Firm* — Kriegsman & Kriegsman

(57) ABSTRACT

The invention relates to a method and a device for monitoring a lifting system (11) for lifting loads, particularly vehicles, in which for lifting a load (14), the lifting movement is initiated by a starting phase, and lifting devices (12) are individually driven in the starting phase. Load holding means (18) of the lifting devices (12) are raised until a pre-set minimum load is detected by the pressure sensor (24), and the load holding means (18) are raised by a pre-selectable displacement distance in a load recognition phase of the lifting process following the starting phase, and after the pre-selected displacement distance is passed through, a load inquiry is carried out and the determined load is stored as a reference value for the further lifting process.

14 Claims, 2 Drawing Sheets

(56) References Cited

U.S. PATENT DOCUMENTS

Figure 1:
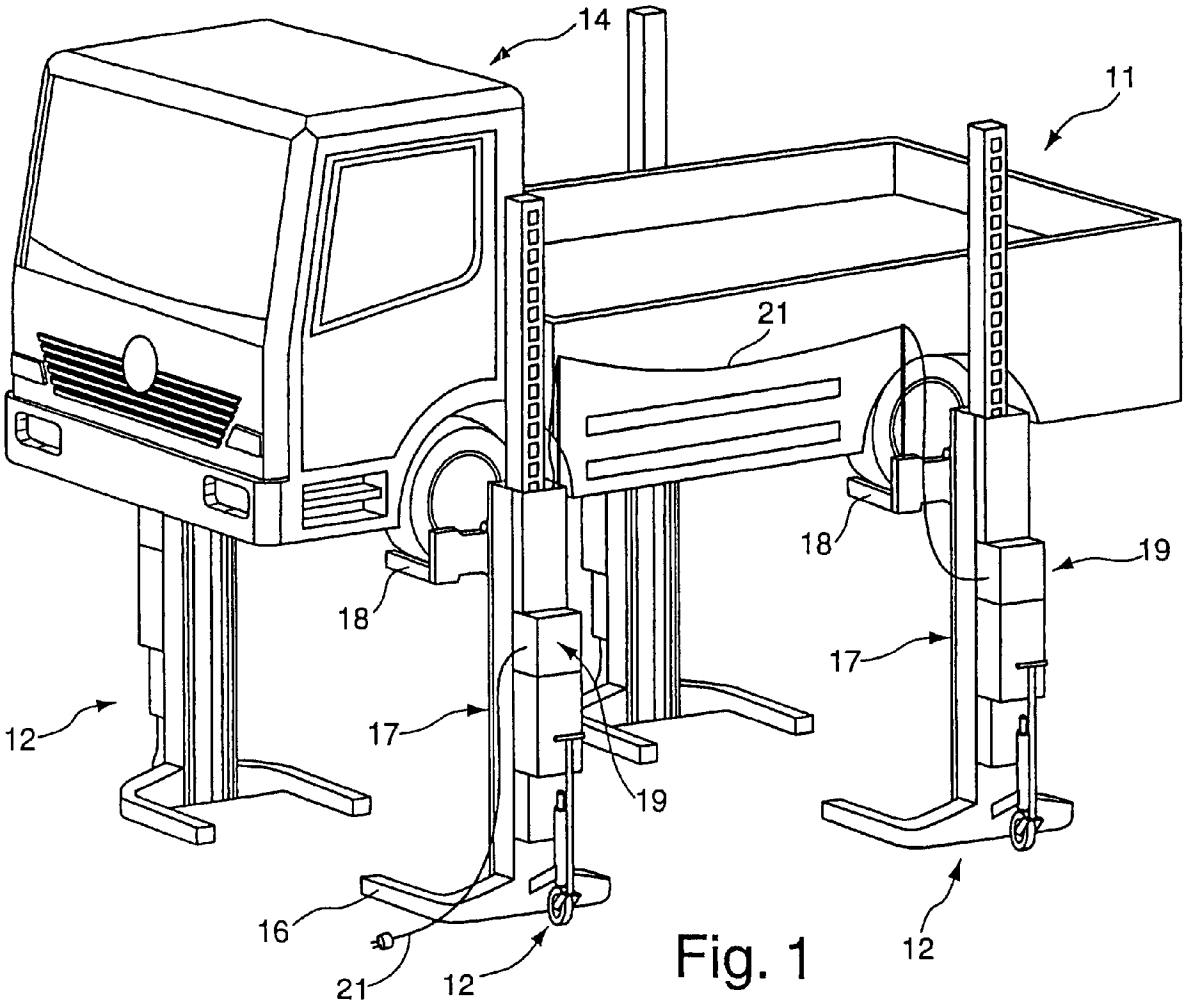

| | | | | |
|---|---|---|---|---|
| 5,012,898 | A * | 5/1991 | Tsymberov | 187/208 |
| 5,110,251 | A * | 5/1992 | Gray | 414/545 |
| 5,184,930 | A * | 2/1993 | Kuhn | 414/427 |
| 5,328,153 | A * | 7/1994 | Levinson | 254/2 R |
| 6,315,079 | B1 * | 11/2001 | Berends et al. | 187/210 |
| 6,634,461 | B1 * | 10/2003 | Baker | 187/247 |
| 6,763,916 | B2 * | 7/2004 | Green et al. | 187/277 |
| 6,964,322 | B2 * | 11/2005 | Green et al. | 187/285 |
| 7,191,038 | B2 * | 3/2007 | Green et al. | 700/275 |
| 2005/0045429 | A1 * | 3/2005 | Baker | 187/277 |
| 2005/0067227 | A1 * | 3/2005 | Wengelski et al. | 187/285 |
| 2009/0236183 | A1 * | 9/2009 | Bordwell et al. | 187/234 |
| 2010/0274514 | A1 * | 10/2010 | Kamachi et al. | 702/94 |

FOREIGN PATENT DOCUMENTS

| | | | | |
|---|---|---|---|---|
| GB | 2 310 519 | A | 8/1997 | |
| JP | 03249076 | A * | 11/1991 | B66B 1/40 |
| JP | 2000 086175 | A | 3/2000 | |

* cited by examiner

METHOD FOR MONITORING A LIFTING SYSTEM

The invention relates to a method and device for monitoring a lifting system for lifting loads, in particular vehicles.

EP 1 285 878 A1 has disclosed a lifting system with at least two lifting devices which comprise a basic framework and a lifting unit. The lifting unit has a lifting cylinder in order to move a load-bearing means up and down for the purpose of lifting and lowering the load. The lifting devices are connected to supply lines, and this allows joint activation.

DE 103 49 424 A1 has disclosed an electrohydraulic lifting installation which is provided for lifting and lowering loads. In order to synchronize the individual lifting trestles, provision is made for the lifting movement of the load-bearing means to take place in predetermined unit-spacing steps. The fact of whether the unit-spacing steps have been achieved in each case is interrogated by a displacement sensor. The lifting trestles further comprise pressure sensors which, during an upward movement of the lifting cylinder of the respective lifting trestle, are intended to sense contact with the load which is to be lifted. The pressure sensor here outputs a signal, during the upward movement, as contact is made with the load as soon as a significant increase in pressure has been initiated in the pressure sensor by the contact between the load which is to be lifted and the lifting cylinder. This is followed by further lifting, in the respective unit-spacing steps, until the desired height has been reached. Furthermore, the pressure sensor is intended to make it possible to ascertain an inadmissible situation during the lifting phase, in which case an alarm signal is triggered. This electrohydraulic lifting installation has the disadvantage that neither is it possible to set the pressure sensors to a specific load which is to be lifted nor is there any monitoring between initial contact of the load-bearing means with the load which is to be lifted and the point in time where there is a significant increase in pressure, it being possible for a considerable vertical distance to be covered here. It is precisely in the transition from a starting phase to the lifting phase that the potential for accidents is particularly high.

The object of the invention is to develop such a lifting system for monitoring the lifting and lowering operation and to increase the safety standard.

This object is achieved according to the invention by a method of monitoring a lifting system for lifting loads, in particular vehicles, having at least two lifting devices, which comprise a basic framework, a lifting unit and a load-bearing means, and having supply lines, by means of which the lifting devices are connected to one another, in the case of which, during lifting or lowering of the load, the load fraction acting on the load-bearing means is sensed by a pressure sensor of the lifting unit and evaluated in a control means, whereby, in order to lift a load, the lifting movement of the load-bearing means is initiated by a starting phase, lifting devices are driven individually in the starting phase, in that the load-bearing means of each lifting device is raised until a preset minimum load is sensed by the pressure sensor, as the load-bearing means act on the load which is to be lifted, and the respective load-bearing means is brought to a standstill when the minimum load is reached, in a load-detection phase of the lifting operation, this phase following the starting phase, the lifting movements of the load-bearing means are continued jointly and the load-bearing means are raised by a preselectable displacement distance, and once the preselected displacement distance has been covered, load interrogation is carried out for each lifting device, and the load determined for each lifting device is stored in each case as a reference value for the further lifting movements of the lifting operation. This object of the invention is further achieved by a lifting system having at least two lifting devices for lifting loads, in particular vehicles, it being the case that the lifting device comprises a basic framework and lifting unit, which moves a load-bearing means up and down by way of a lifting cylinder which is driven by control means, and having at least one supply line, which connects the at least two lifting device to one another, whereby in order to monitor the lifting devices by way of at least one control means, a pressure sensor arranged in the lifting unit can sense a load acting on the load-bearing means. Further advantageous configurations for monitoring purposes are indicated in the rest of the claims.

By virtue of the method according to the invention, the lifting operation is monitored between the moment of initial contact of a load-bearing means with the load which is to be lifted and the point in time where full load bearing takes place. Furthermore, the further lifting operation, following a load-detection phase, is incorporated in the monitoring process with a reference value which is sensed for each working operation. This provides for a high safety standard.

In a starting phase, the load-bearing means of the lifting devices are driven individually. A minimum load and/or a pressure point are/is set on a pressure sensor provided on each lifting device. This ensures that the load-bearing means comes into gentle contact with, and engages gently beneath, the load, and that all the load-bearing means have assumed the same state before a load-detection phase, which follows the starting phase, is initiated. The load-detection phase proceeds over a preselectable displacement distance. At the end of the load-detection phase, a load interrogation is carried out, and the load which is then determined is stored as a reference value for the further lifting movements of the lifting operation. This procedure simultaneously ensures that the same conditions prevail at all the load-bearing means, in order for the lifting operation to be continued under full load.

The minimum load and/or the pressure point for giving a signal are/is adapted, and set preferably in a stepless manner, preferably in dependence on the overall weight of the load and/or on the distribution of the load which is to be lifted. This makes it possible to provide a reliable and flexible system which can be adapted to different situations. For example, it is possible to provide a different number of lifting devices in the lifting system in order to lift and lower the load, in which case the respective minimum load depends on the number of lifting devices. It is also possible to lift loads of different weights, which likewise require adaptation in order for the lifting to continue the further lifting operation from secure, joint intermediate positions.

Proceeding through a first, starting phase of the lifting devices until loading takes place with a minimum load is particularly important, especially in the case of rigid vehicles with no suspension, for example tram cars, locomotives or the like, since the load-bearing means act on the frame of the vehicles, and identical starting situations are thus necessary in order for the load to be lifted reliably.

According to a further advantageous configuration of the method, it is provided that the preset minimum force of each lifting device is set to be smaller than the respective load to be lifted which acts on the load-bearing. This ensures that a signal is outputted as the load-bearing means come into contact with a load, in which case gentle abutment of the load-bearing means against the load is sensed. At this point in time, it is additionally possible to carry out visual monitoring again, since, when the minimum load is reached, the starting phase is terminated and the individual lifting devices are brought to a standstill.

According to a further advantageous configuration of the method, it is provided that the load-detection phase takes place without any load values being sensed. This method step has the advantage that, in the event of any stress peaks occurring when full load bearing takes place, there is no output of fault signals which result in a standstill or in an incorrect reference value being stored. This also avoids the situation where pressure peaks or different pressures are sensed. It is only once the displacement distance of the load-detection phase has been covered that the load rests uniformly on all the load-bearing means, in which case any reference value sensed subsequently to this corresponds to the actual conditions which are used for monitoring the further lifting operation.

The lifting devices of a lifting system are preferably driven synchronously in a first, starting phase until a minimum load is reached. The amount of time required for the lifting operation can thus be shortened. As an alternative, it may be provided that the lifting devices are driven individually in a starting phase. Such individual activation is advantageous in particular in the case of loads which require visual monitoring as the load-bearing means acts on the load.

The preselectable displacement distance is preferably adjustable, and is less than 200 mm. It is thus possible to ensure that, once the displacement distance has been covered, the load has been raised up fully from the ground, or the bearing surface, and acts on the lifting devices.

The load values determined, at the end of the load-detection phase, are preferably stored as reference values for monitoring the further lifting and lowering operation. Dynamic load detection, which always adapts itself to the current situation, is thus possible. It is therefore possible to provide constant monitoring of the actual load values at the individual lifting devices with the load values which are stored for the respective lifting devices, in which case the lifting system is monitored at any other desired point in time of the lifting and lowering operation, or in a raised, resting use position. As soon as the load on a lifting devices decreases, the displacement speed can preferably be increased in order to ensure identical load-bearing capacities at all the lifting devices and to avoid the load becoming skewed. As an alternative, it is preferably also possible to brake the displacement speed of the further lifting devices in order to achieve synchronization. The same applies to the lowering operation.

According to a further advantageous configuration of the invention, it is provided that, in the case of the load values during the lifting phase corresponding with the load values determined at the end of the load-detection phase, or lying within a tolerance range, the lifting operation is continued. This allows constant monitoring throughout the lifting phase, in which case the lifting system is monitored both during a lifting movement and during a lowering movement. Should a fast load value lie outside the tolerance range, the lifting or lowering movement is brought to a standstill.

According to an advantageous embodiment of the method, it is provided that the load values which are sensed by each lifting unit during the lifting operation are compared, in a control means of the lifting system, with the reference values sensed. This makes it possible to compared with one another the load situations for individual lifting devices throughout the lifting system. As a load is lifted and lowered, a constant load is necessary for reliable operation. As soon as a load value sensed deviates from the reference values sensed, or lies outside a tolerance range of the reference values sensed, a hazard situation may be on hand. Such a hazard situation is output by the control means, preferably as a fault signal in the form of an optical and/or acoustic signal, and can preferably also, at the same time, bring the lifting movement of the lifting devices present in the lifting system to a standstill.

In the lifting operation for transferring the load to be lifted into a final lifting position it is preferably provided that the lifting operation is brought to a standstill as soon as the pressure sensor of the lifting device senses a load which is higher than the reference value stored. This can prevent the situation where, during lifting, damage occurs on account of obstructions which are located in the working area above the load which is to be lifted, and cause damage.

It is further advantageously provided that the lowering movement is brought to a standstill as soon as the pressure sensor senses a load which is smaller than the reference value stored. This makes it possible to ensure that objects positioned beneath the load are not crushed, or that the situation where the load is thrown clear of the lifting devices is prevented.

Such monitoring is advantageous particularly when the load rests directly on objects positioned beneath the load and the downward movement of the load-bearing means of the lifting devices is affected. Monitoring is usually provided in respect of synchronization during the lowering movement. In such a case, however, a risk would not be recognized. The additional monitoring of the load means that such a hazard situation is also monitored. Immediately following detection of such a hazard situation, the movement of the lifting devices is stopped.

As soon as a deviation, that is to say a difference, in particular outside a tolerance range, between the reference value and the current load is sensed by the pressure sensor on a lifting device, and is ascertained by a control means, a fault signal is generated. This fault signal can preferably cause all the lifting devices in the lifting system to be brought to a standstill at the same time.

A further advantageous configuration of the method provides for a smooth transition between the load-detection phase and the further lifting and lowering movements. A continuous lifting movement is thus made possible. The starting phase can preferably precede the load-detection phase and the further lifting movement. It is likewise also possible for the lifting movement to be initiated directly with the load-detection phase. The starting phase is advantageous in particular, albeit not solely, in rail vehicles and other vehicles which have a small amount of suspension travel and have tyres which are only compliant to a small extent, if at all.

The loads determined by the pressure sensors are preferably sensed by the control means and indicated. These loads sensed make it possible to determine the individual loads and thus the overall static load, in which case it is possible both to interrogate the prevailing pressures at each lifting device and to output the load which is to be lifted. This can provide an additional monitoring means for the operating staff.

In particular for the purpose of implementing the method, the invention provides a lifting system which comprises at least two lifting devices, each lifting device comprising a pressure sensor which, in a lifting unit for lifting and lowering purposes, comprises a load-bearing means which acts on a load. The signals sensed are passed on to a control means. This allows an evaluation of the active load conditions at the lifting devices of the lifting system. The configuration of the lifting units with a respective pressure sensor allows the individual lifting devices to be used autonomously and independently of one another and to be connected, in dependence on the shape and size of the load, to form a lifting system which makes it possible for a lifting operation to be monitored and, in particular, safeguarded.

Figure 2:
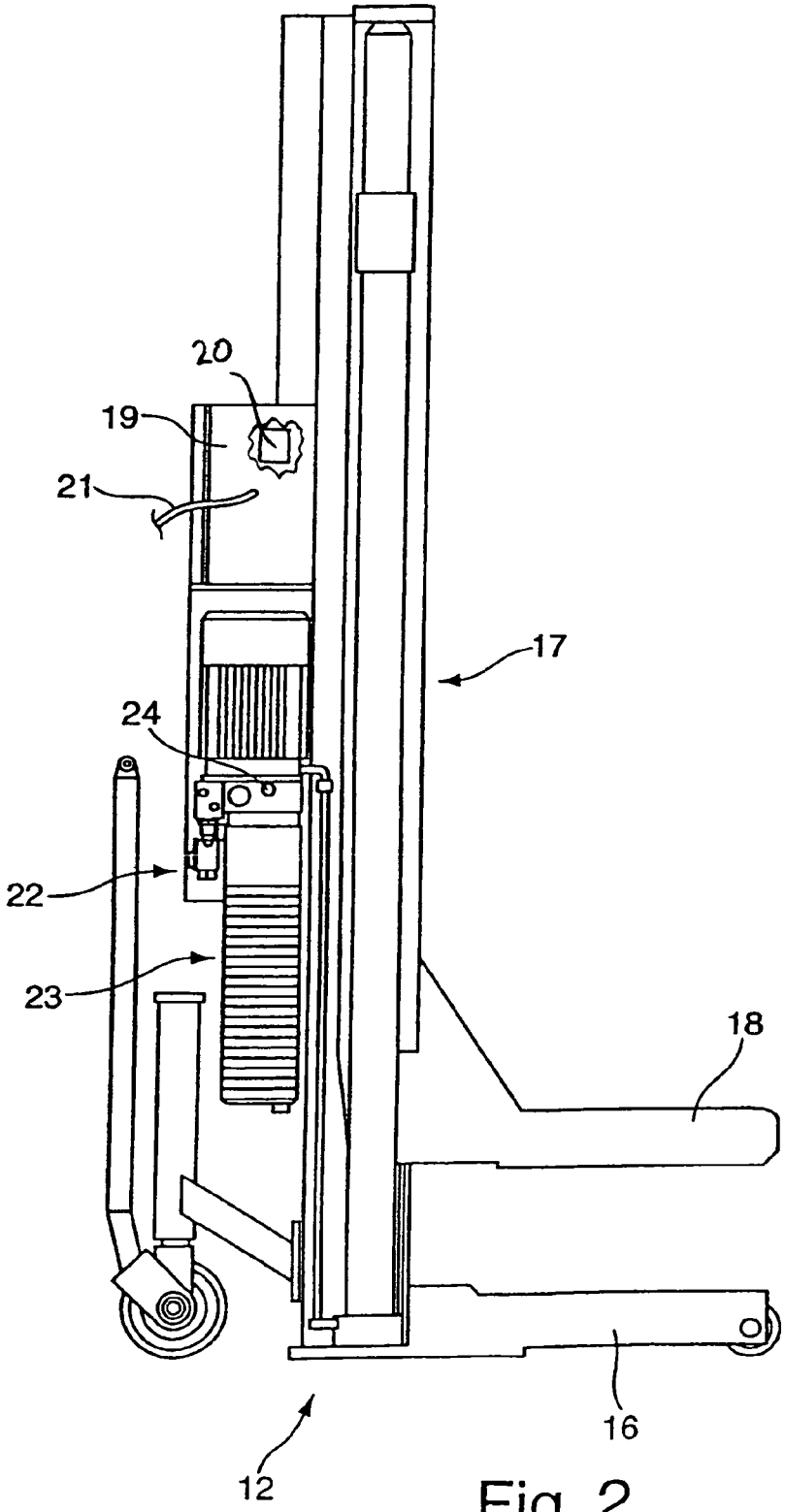

The invention and further advantageous embodiments and developments of the same are explained and described in more detail hereinbelow with reference to the examples illustrated in the drawings. The features which can be gathered from the description and the drawings can be used, according to the invention, on their own or together in any desired combination. In the drawings:

FIG. 1 shows a perspective view of a lifting system according to the invention for lifting a load, and FIG. 2 shows a schematic partial view, broken away in part, of a lifting unit of the lifting device for monitoring the lifting system.

FIG. 1 illustrates a lifting system 11 which is suitable for mobile use. The lifting system 11 comprises a plurality of individual lifting devicess 12 which can be independently displaced and positioned in relation to the load 14. Such lifting systems 11 are used, in particular, for lifting vehicles such as passenger vehicles, commercial vehicles, trucks, buses, tanks, rail vehicles or the like. The lifting device 12 comprises a basic framework 16, a lifting unit 17 and a load-bearing means 18, which is driven by the lifting unit 17. This load-bearing means 18 acts on an underside of the load 14 in order to raise and lower the latter. The lifting device 12 is driven by a lifting cylinder of the lifting unit 17. A control means 19 monitors and controls the lifting unit 17. The individual lifting devices 12 are connected to one another via supply lines 21. These supply lines 21 are energy-supply lines. Control and/or information lines may be provided in addition.

In the case of the load 14 being lifted and lowered, one of the control means 19 of the lifting devices 12 is actuated, and this control means 19 then governs the rest of the control means 19 of the lifting devices 12. As an alternative, it may be provided that the individual control means 19 of the lifting devices 12 are activated by a separate control unit.

FIG. 2 gives a schematic illustration of a lifting unit 17. Provided in the lifting unit 17 is a hydraulic unit 22 with a pressure sensor 24 which, as the load-bearing means 18 is lifted and lowered, senses the load acting thereon and passes a signal on to the control means 19. The pressure sensor 24 may be designed as an exchangeable cartridge which is inserted into the lifting cylinder 23. As an alternative, the pressure sensor 24 may be seated in a flange of the hydraulic unit or in a pressure line.

The monitoring and safeguarding of the lifting system 11 according to the invention means that it is possible for the load-bearing means 18 to initiate the load-detection phase only once a predetermined load point or minimum load has been reached, and then to continue the lifting operation. A defined load-receiving operation and a monitored lifting and/or lowering operation are described hereinbelow:

In the first instance, the lifting devices 12 of the lifting system 11 are positioned in relation to the load 14 while at rest. In the exemplary embodiment, the load-bearing means 18 are designed as wheel grippers and are each positioned in relation to the vehicle such that they engage beneath the wheel. Once the lifting devices 12 have been connected by supply lines 21, and made into a lifting system 11, the control means, in dependence on the weight of the vehicle, sets a minimum load, which is smaller than the load fraction which is to borne by each lifting device 12. The lifting operation is then started. During such a starting phase, initial lifting of the load-bearing means 18 takes place. The load which acts on the load-bearing means 18 during the starting phase is sensed by the pressure sensor 24. Once the predetermined minimum load is acting on the load-bearing means 18, and is sensed by the pressure sensor 24, a signal is passed on to the control means 19. At the same time, the lifting movement of that lifting device 12 which has output the minimum-load signal can be brought to a standstill. The first starting phase is completed when all the lifting devices 12 have been subjected to the minimum load and brought to a standstill.

Once all the lifting devices 12 which form the lifting system 11 have completed the first, starting phase, a load-detection phase is initiated and, during this phase, the load-bearing means 18 are raised by a predetermined distance, for example 50 mm, via the lifting unit 17. Once this displacement distance has been covered, it is assumed that each load-bearing means 18 has received its full load fraction. The load which is sensed by each pressure sensor at the respective lifting device 12 is stored as a reference value for the further lifting and/or lowering operation. In addition, it is possible to check correspondence of the signals sensed with the load fraction which has been calculated and input into the control means. If all the lifting devices 12 output a signal which is greater than the minimum load, and preferably lies within a tolerance range of all the reference values sensed, the further lifting movement of the lifting devices in the lifting system is enabled. In addition, interrogation and checking can be carried out as each load-bearing means 18 covers the distance, in order to ensure that the vehicle is raised up in a horizontal plane, without any inclination. If the load-bearing means 18 act on the load at different heights on account of the geometry of the load, this is taken into account by a displacement-sensing system 20, for example, a string pot.

In, or at the end of, the load-detection phase, or at the beginning of the further lifting operation, the loads determined at each lifting device 12 can be stored as a reference value, and these are used for monitoring purposes in a further lifting and lowering operation. As an alternative to the load-detection phase, which can also be initiated immediately without any preceding starting phase, it is provided that, following an initial stoppage of the lifting movement, the load-detection phase is terminated and a reference value of the load acting on the lifting devicess in each case is stored. This reference value is then used as a basis for the further lifting and/or lowering operation.

As soon as a pressure sensor 24, during the lifting operation, senses a signal which comes above or below the reference value, or a tolerance range in relation to the reference value, the lifting operation is brought to an immediate standstill and a fault signal is output. This makes it possible to monitor the area located above or beneath the load during lifting or lowering.

This is especially advantageous in particular if lifting systems are used for vehicles since the working area is located beneath the vehicles and replacement parts, workshop trucks and other operation means for servicing and/or repairing the vehicles are positioned in the working area. If the working area is not completely free, this would lead to damage to the operating means or the vehicle or even to the vehicle toppling off the lifting system. The lowering movement of the lifting devices is usually monitored by a synchronization control. If the load-bearing means 18 runs up against an object, this is recognized by the synchronization control and a signal is output in order to bring all the lifting devices 12 in the lifting system 11 to a standstill. If, however, the load 14 comes up against an object without a load-bearing means 18 of one of the lifting devices 12 being blocked, the synchronization control does not recognize this hazard situation. However, the monitoring of the load acting on the load-bearing means 18 by means of a pressure sensor 24 means that a reduction in the load is recognized. If the load value which is actually sensed lies outside a tolerance range of the reference value stored, the lifting system 11 is brought to a standstill in order to avoid further damage.

All the features described above are each in themselves pertinent to the invention and may be provided in any desired combinations.

The invention claimed is:

1. A method of monitoring a lifting system for lifting a load, said lifting system having at least two lifting devices, each of which comprises a basic framework, a lifting unit, a load-bearing device, and a supply line, by means of which supply line each lifting device is connected to the other lifting device, and during at least one of lifting and lowering of the load, a fractional amount of the load to be elevated or lowered acting on the load-bearing device is sensed by a pressure sensor of the lifting unit and evaluated in a control unit, wherein in order to initially lift a load, a lifting movement of each load-bearing device is initiated in a starting phase, the lifting devices are driven individually in the starting phase, the load-bearing device of each lifting device is raised until a preset minimum load is sensed by the pressure sensor, as the load-bearing device acts on the load which is to be lifted, and the respective load-bearing device is brought to a standstill when the minimum load is reached, in a load-detection phase of a lifting operation, this phase following the starting phase, lifting movements of the load-bearing devices are continued jointly and the load-bearing devices of the lifting devices are raised a preselectable displacement distance, and once the preselected displacement distance has been covered, load interrogation is carried out for each lifting device, and a load determined for each lifting device is stored in each lifting device as a reference value for further lifting movements of the lifting operation.

2. The method as claimed in claim 1, characterized in that the load values determined at the end of the load-detection phase are stored as reference values for monitoring subsequent lifting and lowering operations.

3. The method as claimed in claim 1, characterized in that load values sensed by each lifting unit during the lifting operation are compared, in said control unit of the lifting system, with the reference values.

4. The method as claimed in claim 3, characterized in that the control unit outputs a fault signal and indicates which lifting device causes the signal.

5. The method as claimed in claim 4, characterized in that the control unit outputs a fault signal and indicates which lifting device causes the signal.

6. The method as claimed in claim 1, characterized in that the lifting devices are driven synchronously in the starting phase.

7. The method as claimed in claim 1, characterized in that the minimum load acting on each lifting device is adjusted in a stepless manner in dependence of an overall weight of the load which is to be lifted or on a distribution of the overall weight of the load which is to be lifted.

8. The method as claimed in claim 1, characterized in that a preset minimum force of each lifting device is set to be smaller than the fractional amount of the load which acts on a respective load-bearing device.

9. The method as claimed in claim 1, characterized in that the displacement distance is set to a vertical distance of less than 200 mm.

10. The method as claimed in claim 2, characterized in that the lifting operation is continued when the load values correspond to, or lie within a tolerance range of, the reference values determined after the end of the load-detection phase.

11. The method as claimed in claim 1, characterized in that the lifting operation for lifting the load is brought to a standstill as soon as a pressure sensor senses a load that deviates from the reference value.

12. The method as claimed in claim 1, characterized in that a lowering operation for lowering the load is brought to a standstill as soon as a pressure sensor senses a load that deviates from the reference value.

13. The method as claimed in claim 1, characterized in that a transition of the lifting movements between the load-detection phase and the further lifting movements is controlled.

14. The method as claimed in claim 1, characterized in that, by signals generated by the pressure sensors, the load acting on the respective lifting device, or static load acting on the lifting system, is determined and indicated by the control unit.

* * * * *